United States Patent [19]

Yamamoto

[11] Patent Number: 4,755,782

[45] Date of Patent: Jul. 5, 1988

[54] MAGNETICALLY OPERATED ACTUATOR HAVING PLURAL PERMANENT MAGNET MEANS

[76] Inventor: Seiji Yamamoto, 2-11-6-406, Tsurukawa, Machida-shi, Tokyo-to, Japan

[21] Appl. No.: 82,488

[22] Filed: Aug. 7, 1987

[30] Foreign Application Priority Data

Aug. 8, 1986 [JP] Japan ..... 61-186675

[51] Int. Cl.[4] ..... H01F 7/08

[52] U.S. Cl. ..... 335/230; 335/81

[58] Field of Search ..... 335/78, 79, 80, 81, 335/229, 230, 234

[56] References Cited

U.S. PATENT DOCUMENTS

| | | | |
|---|---|---|---|
| 4,604,599 | 8/1986 | Koehler | 335/234 X |
| 4,609,899 | 9/1986 | Koehler | 335/234 X |

FOREIGN PATENT DOCUMENTS

| | | | |
|---|---|---|---|
| 0040778 | 5/1981 | European Pat. Off. | 335/230 |
| 1807098 | 4/1979 | Fed. Rep. of Germany | 335/230 |
| 1350614 | 8/1971 | United Kingdom | 335/230 |
| 2111755 | 11/1982 | United Kingdom | 335/230 |
| 2123611 | 7/1983 | United Kingdom | 335/230 |
| 2175144 | 9/1987 | United Kingdom | 335/230 |

OTHER PUBLICATIONS

Japanese Laid Open Patent Publication No. 59-199850.
Japanese Laid Open Patent Publication No. 61-237325.

*Primary Examiner*—George Harris
*Attorney, Agent, or Firm*—Birch, Stewart, Kolasch & Birch

[57] ABSTRACT

A magnetically operated actuator comprises a support structure: a generally elongated operating element mounted on the support structure for selective displacement between first and second positions; at least one electromagnet assembly for driving the operating element to displace the latter between the first and second positions under the influence of magnetism emanating therefrom, which electromagnet assembly comprises a first magnetic member and a solenoid unit disposed around the first magnetic member and adapted to develop a magnetic field when electrically energized, with the first magnetic member being exposed in the magnetic field developed by the solenoid unit when the solenoid unit is electrically energized; and at least two second magnetic members cooperable with the first magnetic member. One of the first and second magnetic members is fixed to the support structure and the other of the first and second magnetic members is fixed to the operating element while the solenoid unit is fixed to the support structure.

13 Claims, 4 Drawing Sheets

MAGNETICALLY OPERATED ACTUATOR HAVING PLURAL PERMANENT MAGNET MEANS

BACKGROUND OF THE INVENTION

The present invention generally relates to a magnetically operated actuator and, more particularly, to the magnetically operated actuator suited for actuating an operating element such as used in, for example, a photographic shutter mechanism, a photographic aperture mechanism, a high-speed on-off electric switch assembly, an electromagnetically operated needle selector used in a knitting machine or any other machine component required to be operated in response to the application of an electric enabling signal.

Numerous magnetically operated actuators for actuating or operating an operating element by the utilization of an interaction between the electromagnet and the permanent magnet are currently commercially available, an example of which is disclosed in, for example, the Japanese Laid-open Patent Publication No. 59-199850, first published Nov. 13, 1984.

All of these prior art magnetically operated actuators make use of a combination of electromagnet and permanent magnet, and the interaction between the magnetic force emanating from the electromagnet, then electrically energized, and the magnetic force emanating from the permanent magnet is utilized to drive the operating element between two spaced apart operative positions. Therefore, in the event of the failure to supply an electric current through a solenoid used in the electromagnet, the interaction between the electromagnet and the permanent magnet no longer occur with the consequence that the movement of the operating element may become insecure. By way of example, in a particular application where the supply of an electric current to the magnetically operated actuator is controlled according to a program uploaded in a programmable computer, the supply of the electric current has to be continued during at least a period of time required for the operating element being moved to reach one of the operative positions. In reality, however, the operating element having reached the operative position and, therefore, impinged upon a stopper defining such respective operative position tends to rebound from the stopper, exhibiting a bouncing motion that attenuates progressively with passage of t time, and, therefore, the periof of t time during which the electric power is required to be actually supplied to the electromagnet is necessarily longer than that required for the operating element to be brought into initial contact with the stopper so that the bouncing motion can be quickly minimized or the attenuation thereof can be accelerated.

Moreover, where the number of the operating elements is increased to provide a multistage actuating capability, and in the event that one of the operating elements then impinging upon the associated stopper undergoes the bouncing motion, the neighboring operating element or elements may be adversely affected by the bouncing motion of such one of the operating element in such a way as to result in an unwanted movement or as to fail to operate properly. Once this happens, the time required for the electric current to be supplied to the electromagnet may be necessarily prolonged to substantially avoid any possible interference of bouncing motion from one operating element to the neighboring operating element or elements.

In view of the foregoing, the currently available, high-performance magnetically operated actuator requires the supply of the electric power for a relatively great length of time, for example, 7 to 10 milliseconds, in order for the operating element to be driven in one direction. This is undesirable not only because a relatively large amount of electric power is consumed, but also because a relatively great amount of heat is generated from the solenoid unit used in the electromagnet assembly. Furthermore, according to the prior art, cases may often happen wherein the above discussed problems cannot be obviated even with the prolonged supply of the electric power.

Apart from the problems inherent in the prior art magnetically operated actuators, the recent trend in the field of industrial machines is that the high speed performance of the operating element is desired to improve the work efficiency. Another demand in the market is for a multistage actuating capability wherein a plurality of operating elements and a corresponding number of drives are combined in a single magnetically operated actuator so that the magnetically operated actuator as a whole can have an improved high-speed performance. Furthermore, the applicability of the magnetically operated actuator in a plural number to meet value-added requirements in the market is also desired for.

However, the use of the plural magnetically operated actuators together with the increase number of the drives connected parallel to each other results in the use of the increased number of the solenoid units which in turn results in the generation of an increased amount of heat from the assembly as a whole. This means that, in order for the discharge of the resultant heat to be facilitated, a relatively large surface area is required for the radiation of the heat and, therefore, the assembly tends to become bulky in size. Specifically, the assembly requires the use of an increased number of heat radiating fins and/or of a forced draft system to facilitate the discharge of heat emitted from the assembly as a whole, resulting in the increased size and cost of the assembly as a whole.

The reduction in number or time of supply of the electric current through the solenoid unit used in the magnetically operated actuator may reduce the amount of heat emitted from the assembly as a whole. However, the reduced number of supply of the electric current results in a loss of the high-speed movement of the operating element and, on the other hand, the reduction in time during which the electric power is supplied results in the unstable movement of the operating element.

The more recent version of the magnetically operated actuator designed to improve the response of the device to the application of an electric current and also to stabilize the movement of the operating element is disclosed in, for example, the Japanese Laid-open Patent Publication No. 61-237325, published Oct. 22, 1986, (which publication corresponds to the U.S. Pat. No. 4,658,230, issued Apr. 14, 1987, to the same inventor as the present invention).

According to this Japanese publication or its U.S. counterpart, there is disclosed a magnetically operated actuator which comprises a generally elongated operating element; an electromagnet assembly for driving the operating element to displace between first and second positions under the influence of magnetism emanating therefrom, said electromagnet assembly comprising an iron core and a solenoid unit disposed around the iron core; a permanent magnet assembly rigidly mounted on the operating element and having a pair of magnetic poles opposite in polarity to each other and having a magnetic field which is developed between the opposite poles; and a stopper member for restricting the stroke of movement of the operating element between the first and second positions. The electromagnet assembly is fixedly supported in position with one of the opposite ends of the iron core situated in the magnetic field developed between the poles of the permanent magnet assembly. The first and second positions are located in the vicinity of the opposite poles of the permanent magnet assembly.

SUMMARY OF THE INVENTION

Accordingly, the present invention has been devised with a view to substantially eliminating the above discussed problems inherent in the prior art magnetically operated actuator and has for its essential object to provide an improved magnetically operated actuator of a type wherein the length of time during which the electric power is supplied can be advantageously minimized with no substantial possibility of the operating element undergoing an erroneous operation.

Another important object of the present invention is to provide an improved magnetically operated actuator of the type referred to above, wherein the emission of heat from the solenoid unit is therefore minimized without the high-speed performance of the operating element being sacrificed.

A further object of the present invention is to provide an improved magnetically operated actuator which is compact in size and which can be used for the fabrication to accomplish the multistage actuating capability.

In order to accomplish the above discussed objects of the present invention, an improved magnetically operated actuator herein disclosed comprises a support structure; a generally elongated operating element mounted on the support structure for selective displacement between first and second positions; at least one electromagnet assembly for driving the operating element to displace the latter between the first and second positions under the influence of magnetism emanating therefrom, said electromagnet assembly comprising a first magnetic member and a solenoid unit disposed around the first magnetic member and adapted to develop a magnetic field when electrically energized, said first magnetic member being exposed in the magnetic field developed by the solenoid unit when said solenoid unit is electrically energized; and at least two second magnetic members cooperable with the first magnetic member. One of said first and second magnetic members is fixed to the support structure and the other of the first and second magnetic members is fixed to the operating element while said solenoid unit is fixed to the support structure.

According to another feature of the present invention, the first magnetic member is made of a permanent magnet having a relatively small coercive force enough to permit the opposite poles of the first magnetic member to be reversed in position with reversal of the direction of the magnetic field developed by the solenoid unit whereas each of said second magnetic members is made of a permanent magnet having a relatively great coercive force enough to permit the opposite poles of the respective second magnetic member not to be affected by, that is, not to be reversed in polarity with or reduced in magnetic force by reversal of the direction of the magnetic field developed by the solenoid unit.

With this construction, it is to be noted that, in actuality, the length of time during which the electric current is allowed to flow in one direction through the solenoid unit depends on the voltage of the direct current supplied to the solenoid unit, the reactance and the resistance of the solenoid unit, and the coercive force of the rod magnet, the cross-sectional area and the length of the rod magnet. However, the result of experiments conducted has shown that the length of time during which the electric current is caused to flow in one direction through the solenoid unit is about a few decade of microsecond. In reality, however, while a fraction of the electric current applied during the length of time required for the applied electric current to set up to a required value is not effectively utilized for driving the operating element and, therefore, the length of time required for the electric current to be supplied to the solenoid unit may be greater than that indicated by the result of experiments, the length of time for the actual application of the electric current to the solenoid unit for driving the operating element in one direction is in the order of not greater than 1 millisecond which is very much shorter than 7 to 10 milliseconds required in the prior art magnetically operated actuator.

The reduction in length of time required for the electric current through the solenoid unit accomplished according to the present invention in turn minimizes the emission of heat from the solenoid unit, the consequence of which is that the magnetically operated actuator need not be provided with a heat-exchange surface of increased surface area and can, therefore, make use of the solenoid unit of reduced size. This feature permits the use of the plural magnetically operated actuators in multistage fashion.

Moreover, according to the present invention, since the amount of heat generated from the solenoid unit per flow of the electric current therethrough in one direction is minimized as hereinabove described, the number of alternating flow of the electric current in the respective opposite directions through the solenoid unit can be increased to attain a high-speed drive of the operating element. In addition, the electric power source of relatively small capacity can be advantageously employed for the magnetically operated actuator of the present invention.

Furthermore, in one preferred embodiment of the present invention, physical friction between movable parts takes place at a minimized number of locations, that is, only at a location where the shaft is journalled to the side walls of the support structure. Therefore, any possible resistance to the angular movement of the operating element can be minimized to achieve a high-speed and stable drive of the operating element.

Furthermore, in another preferred embodiment, since only one of the opposite polarities of the electromagnet assembly, that is, only the polarity developed at the end of the rod magnet forming a part of the electromagnet assembly, is utilized in cooperation with any one of the north pole piece and the south pole piece, the following additional advantage can be obtained.

In the prior art magnetically operated actuator of a type wherein the electromagnet assembly includes an iron core, which possibly corresponds to the rod magnet used in the present invention, in combination with the permanent magnet pieces so that the interaction between the magnetic force developed by the iron core upon the electric energization of the solenoid unit and the magnetic force developed by the permanent magnet pieces can be utilized to drive the operating element, the opposite poles of the electromagnet assembly are utilized. However, it has been found that, since the magnetic force developed between the opposite poles of the electromagnet assembly and the magnetic force possessed by the permanent magnet pieces can not be properly proportionated with each other with no difficulty, there is a relatively great possibility that the driving force required to drive the operating element becomes insecure.

In addition, although it appears that the drive produced by the magnetically operated actuator will theoretically dobule when the opposite poles of the electromagnet assembly are utilized as compared with the case when only one of the opposite poles thereof is utilized, the fact is that the drive produced by the magnetically operated actuator as a whole tends to be cut by half because the proportionated relationship between the magnetic forces produced respectively by the electromagnet assembly and the permanent magnet pieces fails to sustain itself with the result that the magnetic force of attraction produced between the electromagnet assembly and one of the permanent magnet pieces will not match with the magnetic force of repulsion produced between the electromagnet assembly and the other of the permanent magnet pieces. Yet, in the prior art magnetically operated actuator, since at least one of the opposite polarities produced in the electromagnet assembly must be magnetically conducted to a position at which it is actually utilized, the use of a relatively bulky iron core in the electromagnet assembly is necessitated and/or the magnetically operated actuator itself tends to become complicated in structure to such an extent as to result in the deviation in performance from one actuator to another during the manufacture thereof.

In contrast thereto, in the present invention, since the magnetic force developed from only one of the opposite poles of the electromagnet assembly is utilized, that is, only one end of the rod magnet is utilized, in cooperation with the magnetic field developed between the permanent magnet pieces, the problem associated with the difficulty in proportionating the magnetic forces as hereinabove discussed in connection with the prior art magnetically operated actuator can be substantially eliminated, permitting the magnetically operated actuator of the present invention to be stable and reliable in operation and to be manufactured compact in size and light in weight.

BRIEF DESCRIPTION OF THE DRAWINGS

In any event, the present invention will become more clearly understood from the following detailed description of preferred embodiments thereof, when taken in conjunction with the accompanying drawings. However, the embodiments and the drawings are given only for the purpose of illustration and explanation, and are not to be taken as being limitative of the present invention in any way whatsoever, whose scope is to be determined solely by the appended claims. In the drawings, like reference numerals denote like parts in the several views, and:

DETAILED DESCRIPTION OF THE EMBODIMENTS

Figure 1:
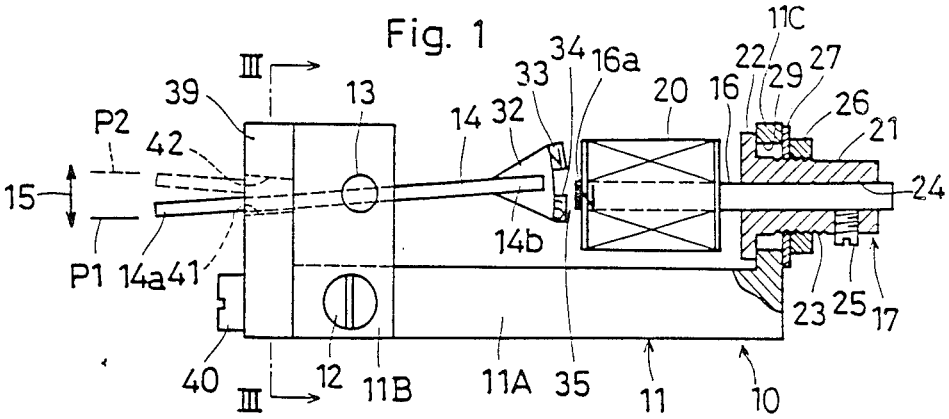
FIG. 1 is a schematic side view, with a portion cut away, of a magnetically operated actuator according to a first preferred embodiment of the present invention.

Referring first to FIGS. 1 to 4, a magnetically operated actuator according to a first preferred embodiment of the present invention comprises a support structure 10 including a generally L-shaped body 11 comprised of an elongated base 11A and an upright wall 11C integral with one end of the base 11A and extending perpendicular to the base 11A. The support structure 10 also includes a pair of generally rectangular side walls 11B secured by means of screws 12 to opposite side faces of the base 11A at the opposite end portion of the base 11A so as to confront with each other. A generally plate-like operating member 14 is pivotally supported by the side walls 11B by means of a shaft or pin member 13 journalled at its opposite ends to the respective side walls 11B. The mounting of the operating member 14 on the shaft 13 may be carried out in any suitable manner, but in the illustrated embodiment the shaft 13 has its substantially intermediate portion slotted axially for the passage of the operating member 14 therethrough and the operating member 14 so passed through the slot in the shaft 13 is fixed in position for movement together with the shaft 13.

The magnetically operated actuator also comprises a first magnetic member comprised of a rod magnet 16 supported at one end by the upright wall 11C through a fixture 17, and an electromagnetic solenoid unit 20 fixedly mounted on the rod magnet 16 and positioned between the upright wall 11C and the side walls 11B.

The fixture 17 is in the form of a generally tubular body 21 having one end integrally formed with a radially outwardly extending flange 22 and having an axial bore 24 defined therein for the passage of the rod magnet 16 therethrough. The upright wall 11C of the support body 11 has a mounting hole 29 defined therein for the passage of the tubular body 21 therethrough.

The outer peripheral surface of the tubular body 21 is formed with a helical thread 23 on which a fastening nut 26 is adjustably mounted so that the tubular body 21 after having been passed through the mounting hole 29 in the upright wall 11C of the support body 11 can be retained in position with the upright wall 11C firmly clamped between the flange 22, integral with the tubular body 21, and the fastening nut 26. When the tubular body 21 is to be mounted in the manner described above, an annular washer 27 may be interposed between the upright wall 11C and the fastening nut 26.

With the fixture 17 so supported by the support body 11, the end portion of the rod magnet 16 remote from the solenoid unit 20 is inserted into the axial bore 24 in the tubular body 21 so as to extend generally over the entire length of the tubular body 21. The fixture 17 includes an adjustment screw 25 adjustably threaded through the wall of the tubular body 21 in a direction perpendicular to the longitudinal axis of the tubular body 21 so that, by fastening the adjustment screw 25, the position of the solenoid unit 20 relative to the upright wall 11C or the fixture 17 can be fixed. Preferably, the mounting hole 29 defined in the upright wall 11C for the support of the fixture 17 has a diameter slightly greater than the outer diameter of the tubular body 21 so that the position of the fixture 17 and, hence, that of the rod magnet 16, in a radial direction thereof relative to the upright wall 11C can be adjusted prior to the fastening of the fastening nut 26. Thus, it will readily be seen that the rod magnet 16 so supported can be adjusted in position in two directions axially and radially thereof.

The generally elongated plate-like operating member 14 so supported on the shaft 13 as hereinbefore described is angularly displaceable about the longitudinal axis of the shaft 13. More specifically, the operating member 14 has one end **14*b* positioned in the vicinity of the solenoid unit 20 and the opposite end 14*a* positioned on one side of the shaft 13 remote from the solenoid unit 20 and adapted to actuate any suitable driven member. As will become clear from the description made later, the actuating end 14*a* of the operating member 14 is, during the pivotal displacement thereof, movable between first and second positions P1 and P2 which are defined by a stopper defining plate 39 secured by means of one or more set screws or bolts 40 to a free end of the base 11A of the support structure 10 in face-to-face relationship with the upright wall 11C**.

Figure 2:
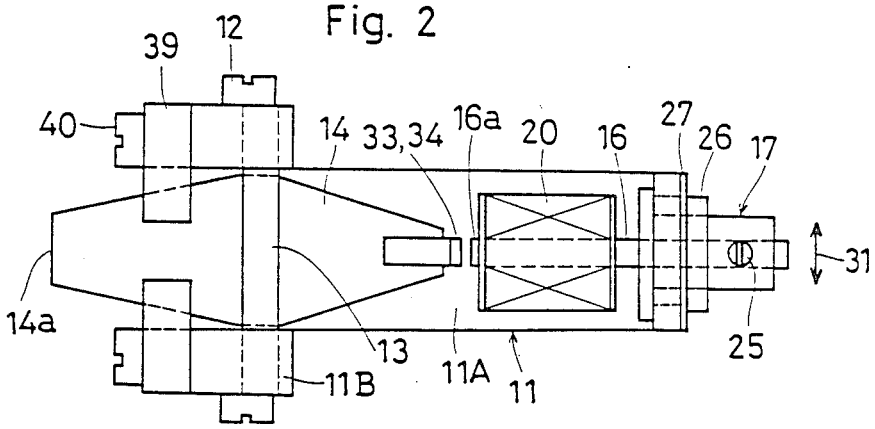
FIG. 2 is a schematic top plan view of the magnetically operated actuator shown in FIG. 1.
Figure 3:
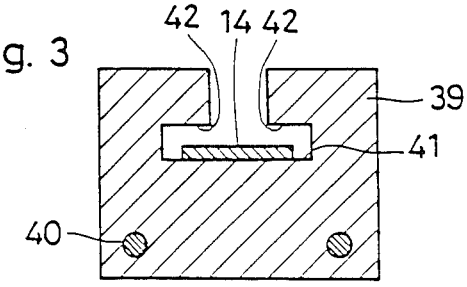
FIG. 3 is a cross-sectional view taken along the line III—III in FIG. 1.

As best shown in FIG. 3, the stopper defining plate 39 has a generally inverted T-shaped opening defined therein so as to leave a pair of spaced stopper faces 41 and 42 which are positioned one above the other in a direction conforming to the direction of pivotal displacement of the operating member 14. As shown in FIGS. 1 to 3, the stopper defining plate 39 is secured to the base 11A of the support structure 10 with the operating member 14 loosely extending through a horizontal portion of the inverted T-shaped opening in the stopper defining plate 29, the space between the stopper faces 41 and 42 being so selected and so sized as to define the first and second positions P1 and P2, respectively. Alternatively, a stopper means for defining the first and second positions P1 and P2 may be of any suitable construction and, instead of the specific stopper defining plate 39, a pair of spaced stopper pieces may be integrally formed with one or both of the side walls 11B so as to protrude in a direction generally perpendicular to the longitudinal axis of the operating member 14.

The end **14*b* of the operating member 14 opposite to the actuating end 14*a* thereof carries a mount 32 having a pair of second magnetic members carried thereby in spaced relationship with each other. Each of the second magnetic members is comprised of a permanent magnet pieces 33 and 34. These permanent magnet pieces 33 and 34 are rigidly secured in any suitable manner, for example, by bonding, to the mount 32 and are spaced a predetermined distance from each other in a direction conforming to the direction of displacement of the operating member 14. In the practice of the present invention, only one magnetic polarity of each of the magnet pieces 33 and 34 is utilized and, therefore, in mounting the magnet pieces 33 and 34 to the mount 32, these magnet pieces 33 and 34 are secured to the mount 32 with their north and south poles facing outwards in a direction away from the mount 32. It is to be noted that, for the purpose of the description of the present invention, the magnet piece 33, whose north pole is utilized in the practice of the present invention, and the magnet piece 34** whose south pole is similarly utilized are referred to as the N-pole piece and the S-pole piece, respectively.

While the N-pole and S-pole pieces 33 and 34 are so mounted on the mount 32, a predetermined clearance 35 is formed between each of the N-pole and S-pole pieces 33 and 34 and one end **16*a* of the rod magnet 16. This clearance 35 is so sized that the N-pole and S-pole pieces 33 and 34 can magnetically selectively interact with the end 16*a* of the rod magnet 16, in a manner as will be described later, to drive the operating member 14**.

In the construction described hereinabove, the rod magnet 16 is made of a permanent magnet having a relatively small coercive force enough to permit the polarities at the opposite ends of the rod magnet 16 to be reversed with reversal of the direction of a magnetic field developed by the solenoid unit 20, that is, with reversal of the direction of flow of an electric current through the solenoid unit 20. Examples of material for the rod magnet 16 which can exhibit a satisfactory physical strength for required for the rod magnet 16 include, for example. Alnico and Spinex. Therefore, the rod magnet 16 used in the practice of the present invention has a coercive force of 150 to 1,500 oersteds, preferably 200 to 500 oersteds. If the coercive force of the rod magnet 16 is greater than 1,500 oersteds, the reversal in polarity between the opposite ends of the rod magnet 16 will not take place with no difficulty, but if it is smaller than 150 oersteds, there will be a possibility that, the particular polarity established at the end **16*a* of the rod magnet 16 will be counteracted by the polarity of any one of the N-pole and S-pole pieces 33 and 34 positioned in the close vicinity of the end 16*a* of the rod magnet 16 so much as to result in the unstable movement of the operating member 14**.

On the other hand, the N-pole and S-pole pieces 33 and 34 are identical in structure and are made of a permanent magnet having such a relatively high coercive force that the polarity of each of the N-pole and S-pole pieces 33 and 24 will not be affected by, that is, not be reversed in polarity with or reduced in magnetic force by reversal of the direction of a magnetic field developed by the solenoid unit 20, that is, with reversal of the direction of flow of an electric current through the solenoid unit 20. The material for each of the N-pole and S-pole pieces 33 and 34 includes, for example, a magnet containing a rare earth such as samarium or cobalt, which magnet is advantageous in that, for a given size, it can provide a relatively high magnetic force. Therefore, each of the N-pole and S-pole pieces 33 and 34 used in the practice of the present invention has a coercive force of about 5,000 oersteds or more. Instead of the magnet containing the rare earth referred to above, a ferrite magnet having a coercive force of 2,000 oersteds or more may be employed, however, the ferrite magnet will require a relatively bulky size for the same magnetic force produced by the magnet containing the rare earth.

In assembling the magnetically operated actuator according to the embodiment shown in and described with particular reference to FIGS. 1 to 3, the rod magnet 16 should be so carefully positioned and so firmly retained in position by fastening the fastening nut 26 to cause the upright wall 11C to be firmly clamped between the flange 22 and the nut 26 that the end 16*a* of the rod magnet 16 can align with the center of magnetic equilibrium between the N-pole and S-pole pieces 33 and 34 incident to the displacement of the operating element, that is, at the point at which the respective magnetic forces produced by the N-pole and S-pole pieces 33 and 34 assume an equilibrium and that the predetermined clearance 35 can be formed between any one of the N-pole and S-pole pieces 33 and 34 and the end 16*a* of the rod magnet 16.

It is to be noted that, if the clearance 35 is excessively small, it may happen that, when the polarity at the end 16*a* of the rod magnet 16 is to be reversed to the opposite polarity by the reversal of the direction of the magnetic field then developed by the solenoid unit 20, the satisfactory reversal will not take place under the influence of the magnetic force developed by either one of the N-pole and S-pole pieces 33 and 34. On the other hand, if the clearance 35 is excessively large, the force of attraction acting between the end 16*a* of the rod magnet 16 and one of the N-pole and S-pole pieces 33 and 34 and the force of repulsion acting between the end 16*a* and the other of the N-pole and S-pole pieces 33 and 34 will be weakened enough to result in an unstable drive of the operating member 14. In practice, therefore, the clearance 35 should be adjusted to the predetermined value by positioning the rod magnet 16 relative to the fixture 17, which predetermined value depends on the considerations of the magnetic forces developed by all of the solenoid unit 20, the N-pole piece 33 and the S-pole piece 34 and the force required to be applied to the operating member 14 to move the actuating end 14a between the first and second positions P1 and P2.

While the magnetically operated actuator according to the first preferred embodiment of the present invention is so constructed and so structured as hereinbefore described, the actuating end 14*a* of the operating member 14 may be operatively counted either directly or indirectly with a movable contact member of a high-speed on-off switch assembly, a shutter release member of a shutter mechanism used in a photographic camera or any other suitable driven member or device. Alternatively, the actuating end 14*a* itself may be so designed and so configured as to provide a photographic shutter blade itself or a switch contact. In the foregoing description, the use of the single operating member 14 in combination of the single electromagnet assembly on one support structure 10 has been referred to, but in a variant of the present invention a plurality of operating members in combination with a corresponding number of electromagnet assemblies may be mounted on the single support structure. In either cases, the solenoid unit or units are to be electrically connected with a source of electric power through a programmable control unit such as a computer so that the operating members can be driven according to an operating program uploaded in the control unit.

The magnetically operated actuator according to the present invention operates in the following manner.

Let it be assumed that the permanent magnet piece 33 has its North pole oriented towards the end 16*a* of the rod magnet 16 and the permanent magnet piece 34 has its South pole oriented towards the same end 16*a*, as hereinbefore described, and that the end 16*a* of the rod magnet 16 is polarized to the North pole as shown as a result of the supply of an electric current in one of the first and second directions opposite to each other, for example, in the first direction, through the solenoid unit 20. In this condition, the magnetic force of attraction is developed across the clearance 35 between the S-pole piece 34 and the end 16*a* of the rod magnet 16 and the magnetic force of repulsion is developed across the clearance 35 between the N-pole piece 33 and the end 16*a*, and, therefore, the operating member 14 is pivoted counterclockwise, as viewed in FIG. 1, about the shaft 13 with the actuating end 14*a* consequently held at the first position P1 as shown by the solid line.

However, when the flow of the electric current through the solenoid unit 20 is reversed to the second direction, the respective polarities at the opposite ends of the rod magnet 16 is reversed with the end 16*a* consequently polarized to the South pole. No sooner than is this condition established, the magnetic force of attraction is developed between the end 16*a* of the rod magnet 16 and the N-pole piece 33 while the magnetic force of repulsion is developed between the end 16*a* and the S-pole piece 34, causing the operating member 14 to pivot clockwise as viewed in FIG. 1 about the shaft 13 with the actuating end 14*a* consequently moved from the first position P1 to the second position P2.

Thus, it will readily be seen that the operating member 14 can be repeatedly driven with the actuating end 14*a* reciprocating between the first and second positions P1 and P2, when the direction of flow of the electric current through the solenoid unit 20 is alternated.

The length of time during which the electric current is supplied in one direction through the solenoid unit 20 is of a value required to effect the reversal in polarity between the opposite ends of the rod magnet 16. Specifically, once the polarity at the end 16*a* of the rod magnet 16 is reversed to the opposite polarity, the supply of the electric current through the solenoid unit 20 may be interrupted. This is because, even though the supply of the electric current through the solenoid unit 20 is interrupted immediately after the reversal of the polarity at the end 16*a* of the rod magnet 16, the end 16*a* of the rod magnet 16 which is a permanent magnet retains the polarity as characteristic of the permanent magnet and, therefore, the operating member 14 can be assuredly displaced until the actuating end 14*a* thereof arrives at either one of the first and second positions P1 and P2 depending on the direction of flow of the electric current through the solenoid unit 20. Once the actuating end 14*a* of the operating member 14 has arrived at one of the first and second positions P1 and P2, it can be assuredly retained in position at such one of the first and second positions P1 and P2 by the effect of the magnetic force developed between the associated magnet piece 33 or 34 and the end 16*a* of the rod magnet 16 until the next succeeding reversal in polarity at the end 16*a* of the rod magnet 16 is effected. This feature advantageously minimizes or substantially eliminates any possible bouncing motion of the operating member 14 which would occur when the operating member being angularly displaced about the shaft 13 impinged upon the associated stopper face 41 or 42 in the stopper defining plate 39.

It is to be noted that, in actuality, the length of time during which the electric current is allowed to flow in one direction through the solenoid unit 20 depends on the voltage of the direct current supplied to the solenoid unit 20, the reactance and the resistance of the solenoid unit 20, and the coercive force of the rod magnet 16, the cross-sectional area and the length of the rod magnet 16. However, the result of experiments conducted has shown that the length of time during which the electric current is caused to flow in one direction through the solenoid unit 20 is about a few decade of microsecond. In reality, however, while a fraction of the electric current applied during the length of time required for the applied electric current to set up to a required value is not effectively utilized for driving the operating member 14 and, therefore, the length of time required for the electric current to be supplied to the solenoid unit may be greater than that indicated by the result of experiments, the length of time for the actual application of the electric current to the solenoid unit for driving the operating member 14 in one direction is in the order of not greater than 1 millisecond which is very much shorter than 7 to 10 milliseconds required in the prior art magnetically operated actuator.

The reduction in length of time required for the electric current through the solenoid unit accomplished according to the present invention in turn minimizes the emission of heat from the solenoid unit 20, the consequence of which is that the magnetically operated actuator need not be provided with a heat-exchange surface of increased surface area and can, therefore, make use of the solenoid unit 20 of reduced size. This feature permits the use of the plural magnetically operated actuators in multistage fashion.

Moreover, according to the present invention, since the amount of heat generated from the solenoid unit 20 per flow of the electric current therethrough in one direction is minimized as hereinabove described, the number of alternating flow of the electric current in the respective opposite directions through the solenoid unit 20 can be increased to attain a high-speed drive of the operating member 14. In addition, the electric power source of relatively small capacity can be advantageously employed for the magnetically operated actuator of the present invention.

In the embodiment shown in and described with reference to FIGS. 1 to 3, physical friction between movable parts takes place at a minimized number of locations, that is, only at a location where the shaft 13 is journalled to the side walls 11B. Therefore, any possible resistance to the angular movement of the operating member 14 can be minimized to achieve a high-speed and stable drive of the operating member 14.

Furthermore, in the illustrated embodiment, since only one of the opposite polarities of the electromagnet assembly, that is, only the polarity developed at the end **16*a* of the rod magnet 16 forming a part of the electromagnet assembly, is utilized in cooperation with any one of the N-pole piece 33 and the S-pole piece 34**, the following additional advantage can be obtained.

In the prior art magnetically operated actuator of a type wherein the electromagnet assembly includes an iron core, which possibly corresponds to the rod magnet used in the present invention, in combination with the permanent magnet pieces so that the interactionb etween the magnetic force developed by the iron core upon the electric energization of the solenoid unit and the magnetic force developed by the permanent magnet pieces can be utilized to drive the operating member, the opposite poles of the electromagnet assembly are utilized. However, it has been found that, since the magnetic force developed between the opposite poles of the electromagnet assembly and the magnetic force possessed by the permanent magnet pieces can not be properly proportionated with each other with no difficulty, there is a relatively great possibility that the driving force required to drive the operating member becomes insecure.

In addition, although it appears that the drive produced by the magnetically operated actuator will theoretically double when the opposite poles of the electromagnet assembly are utilized as compared with the case when only one of the opposite poles thereof is utilized, the fact is that the drive produced by the magnetically operated actuator as a whole tends to be cut by half because the proportionated relationship between the magnetic forces produced respectively by the electromagnet assembly and the permanent magnet pieces fails to sustain itself with the result that the magnetic force of attraction produced between the electromagnet assembly and one of the permanent magnet pieces will not match with the magnetic force of repulsion produced between the electromagnet assembly and the other of the permanent magnet pieces. Yet, in the prior art magnetically operated actuator, since at least one of the opposite polarities produced in the electromagnet assembly must be magnetically conducted to a position at which it is actually utilized, the use of a relatively bulky iron core in the electromagnet assembly is necessitated and/or the magnetically operated actuator itself tends to become complicated in structure to such an extent as to result in the deviation in performance from from one actuator to another during the manufacture thereof.

In contrast thereto, in the present invention, since the magnetic force developed from only one of the opposite poles of the electromagnet assembly is utilized, that is, only one end of the rod magnet is utilized, in cooperation with the magnetic field developed between the permanent magnet pieces, the problem associated with the difficulty in proportionating the magnetic forces as hereinabove discussed in connection with the prior art magnetically operated actuator can be substantially eliminated, permitting the magnetically operated actuator of the present invention to be stable and reliable in operation and to be manufactured compact in size and light in weight.

It is to be noted that, in a particular application where the use of the single rod magnet 16 and the two permanent magnet pieces 33 and 34 would not bring about a sufficient driving force for driving the operating member 14 and a sufficient driving speed at which the operating member 14 is driven, the use may be made of at least one extra permanent magnet piece fixedly mounted on the operating member 14 together with at least one extra electromagnet assembly similar to that comprised of the rod magnet 16 and the solenoid unit 20 to attain the required driving force and the driving speed.

In the foregoing embodiment shown in and described with reference to FIGS. 1 to 3, the operating member 14 has been shown and described as pivotable in a plane orthogonal to the base 11A of the support structure 10. However, in accordance with the teachings of the present invention, it is possible to render the operating member 14 to pivot in a plane parallel to the base 11A of the support structure 10, an example of which is shown in FIGS. 4 and 5.

Figure 4:
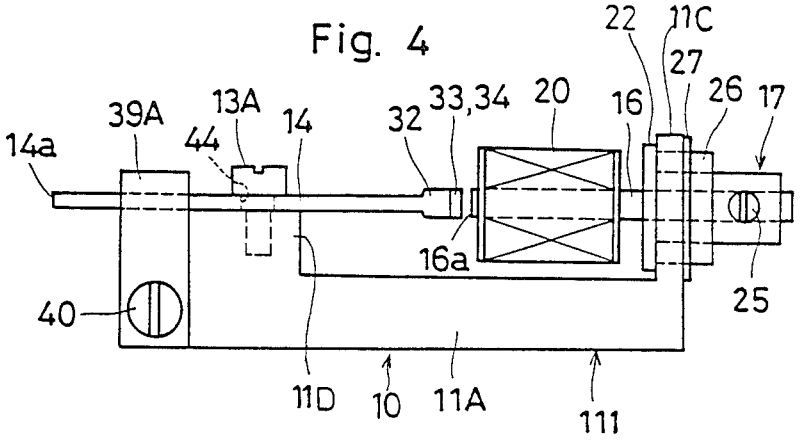
FIG. 4 is a schematic side view of the magnetically operated actuator according to a second preferred embodiment of the present invention.
Figure 5:
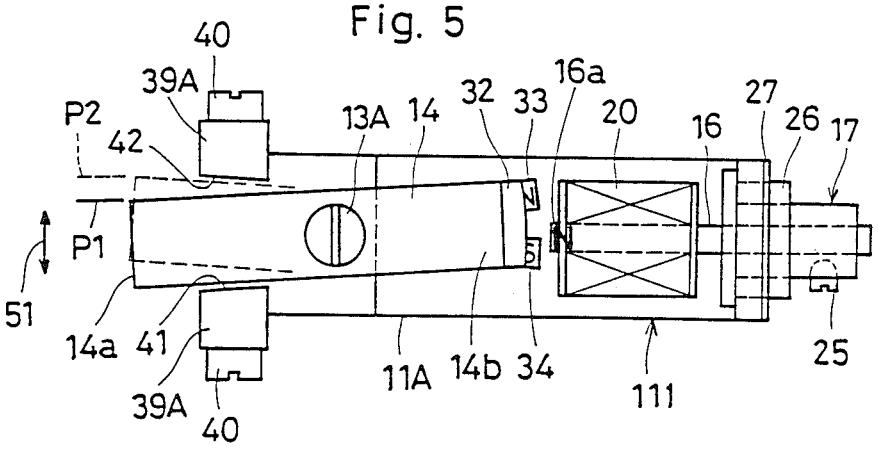
FIG. 5 is a schematic top plan view of the magnetically operated actuator shown in FIG. 4.

Referring now to FIGS. 4 and 5 illustrating a second preferred embodiment of the present invention, the support structure 10 employs a generally U-shaped body 111 unlike the generally L-shaped body 11 employed in the foregoing embodiment. The U-shaped body 111 has, in addition to the base 11A and the upright wall 11C, an additional upright wall 11D formed integrally with the base 11A at one end thereof remote from, and in face-to-face relationship with, the upright wall 11C so as to extend perpendicular to the base 11A, said additional upright wall 11D having a height smaller than the height of the upright wall 11C above the base 11A. Specifically, the height of the additional upright wall 11D above the base 11A is so selected as to permit the additional upright wall 11D to have a top surface generally in flush with the rod magnet 16.

The operating member 14 is pivotally mounted on the top surface of the additional upright wall 11D by means of a pin or screw 13A extending through a mounting hole 44, defined in a generally intermediate portion of the operating member 14, and threaded into the additional upright wall 11D, whereby the operating member 14 can pivot in a plane parallel to the top surface of the upright wall 11D with the actuating end **14*a* thereof moving between the first and second positions P1 and P2 which are also spaced in a plane parallel to the base 11A**.

The first and second positions P1 and P2 in the second preferred embodiment of the present invention shown in FIGS. 4 and 5 are defined by respective stopper plates generally identified by 39A. These stopper plates 39A are positioned on one side of the additional upright wall 11D remote from the upright wall 11C and are secured to the opposite side faces of the base 11A by means of respective set screws 40. Respective inner surfaces 41 and 42 of these stopper plates 39A, which face towards with each other, are utilized as abutment surfaces engageable with the operating member 14 when the latter is pivoted from the second position P2 towards the first position P1 and from the first position P1 towards the second position P2, respectively.

Even the magnetically operated actuator according to the second preferred embodiment shown in and described with reference to FIGS. 4 and 5 can function in a manner similar to, and can bring about effects similar to those brought about by, the magnetically operated actuator according to the foregoing embodiment.

It is to be noted that, in the embodiment shown in FIGS. 4 and 5, instead of the employment of the stopper plates 39A, the top surface of the additional upright wall 11D may be recessed inwardly for accommodating therein the operating member 14, the recess being so sized that the width thereof as measured across the operating member 14 can correspond to the span between the stopper plates 39A referred to above. Alternatively, instead of the employment of the separate stopper plates 39A, the stopper defining plate 39 shown in FIG. 3 and used in the foregoing embodiment could be equally used in this second preferred embodiment.

Even in the second preferred embodiment shown in and described with reference to FIGS. 4 and 5, should the use of the single rod magnet 16 and the two permanent magnet pieces 33 and 34 not bring, in a particular application, about a sufficient driving force for driving the operating member 14 and a sufficient driving speed at which the operating member 14 is driven, the use may be made of at least one extra permanent magnet piece fixedly mounted on the operating member 14 together with at least one extra electromagnet assembly similar to that comprised of the rod magnet 16 and the solenoid unit 20 to attain the required driving force and the driving speed.

Figure 6:
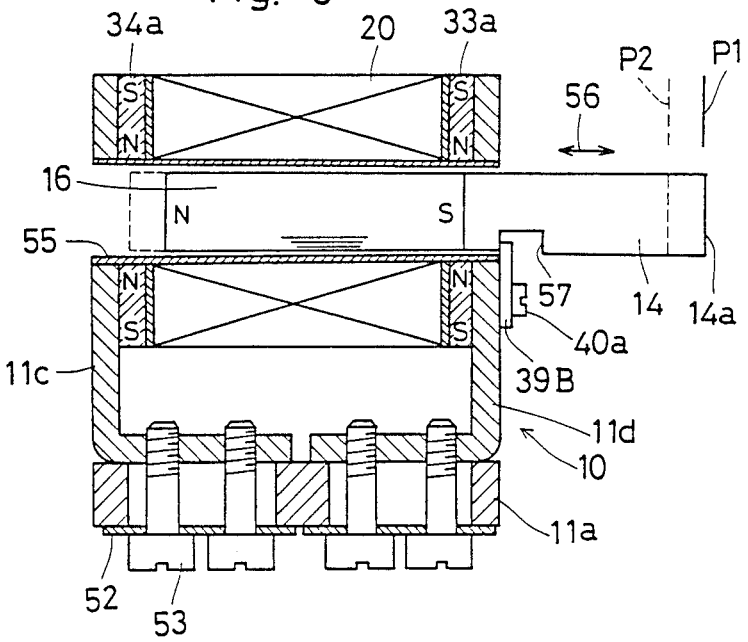
FIG. 6 is a schematic side sectional view of the magnetically operated actuator according to a third preferred embodiment of the present invention.
Figure 7:
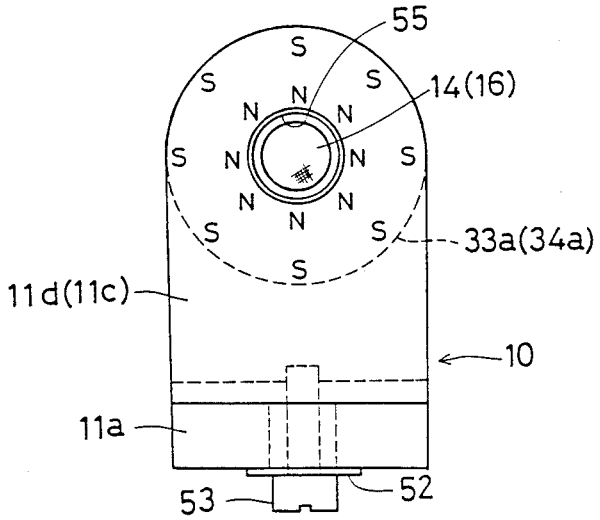
FIG. 7 is an end view of the magnetically operated actuator shown in FIG. 6.

In a third preferred embodiment of the present invention shown in FIGS. 6 and 7, arrangement is made to permit the operating member 14 to move between the first and second positions P1 and P2 in a direction axially thereof and also axially of the rod magnet 16.

Referring to FIGS. 6 and 7, the support structure 10 comprises a generally rectangular base **11*a* having two slots defined therein in spaced relationship with each other, and a pair of generally L-shaped frame members 11*c* and 11*d* each made of a non-magnetizable material, said L-shaped frame members 11*c* and 11*d* being so mounted on and so retained firmly in position above the base 11*a* by means of a plurality of set screws 53, extending through respective perforations in a common washer member 52 and threaded to the L-shaped frame member 11*c*, that the support structure 10 as a whole can assume a generally U-shaped configuration as best shown in FIG. 6**.

A length of tube 55 made of a non-magnetizable material, for example, brass, is carried by the L-shaped frame members **11*c* and 11*d* with its opposite ends pressure-fitted into respective holes defined in the frame members 11*c* and 11*d* so as to extend parallel to the base 11*a*. The solenoid unit 20 mounted externally on the tube 55 and positioned between the frame members 11*c* and 11*d*, which solenoid unit 20 in this embodiment may be formed by forming a winding around the length of tube 55. Permanent magnet rings 33*a* and 34*a* which functionally correspond respectively to the permanent magnet pieces 33 and 34 employed in the foregoing embodiment are respectively secured by means of, for example, bonding to the opposite annular ends of the solenoid unit 20, and the assembly of the solenoid unit 20 and the permanent magnet rings 33*a* and 34*a* is firmly sandwiched between the frame members 11*c* and 11*d* while mounted around the length of tube 55**.

Each of the permanent magnet rings **33*a* and 34*a* exhibits a North pole at an inner peripheral edge thereof and a South pole at an outer peripheral edge thereof. Thus, it will be readily understood that, with the permanent magnet rings 33*a* and 34*a* so mounted on the length of tube 55 and positioned on respective sides of the solenoid unit 20, the same poles of the respective permanent magnet rings 33*a* and 34*a*, the North poles so far shown, are positioned close to the length of tube 55**.

The rod magnet 16 extends inside the length of tube 55 for sliding motion in a direction parallel to the longitudinal axis of the length of tube 55 and has one of the opposite ends, for example, a S-pole end rigidly connected, for example, rigidly bonded, with the operating member 14 in coaxial relationship. The operating member 14 used in this embodiment is preferably in the form of a round rod of a diameter equal to the diameter of the rod magnet 16 and has a cutout defined at 57 on the peripheral surface thereof. Cooperative with this cutout 57 in the operating member 14 is a generally rectangular stopper plate 39B having one end secured to the frame member **11*d* by means of a set screw or bolt 40*a* and the other end terminating inside the cutout 57 in the operating member 14. The stopper plate 39B in combination with the cutout 57 constitutes the stopper means for defining the stroke of axial movement of the operating member 14 between the first and second positions P1 and P2 which are, in the embodiment of FIGS. 6 and 7, spaced in a direction axially of the operating member 14. As a matter of course, the width of the cutout 57 in the operating member 14 as measured in a direction axially of the operating member 14 is so selected as to correspond with the span between the first and second positions P1 and P2**.

In the embodiment shown in and described with reference to FIGS. 6 and 7, the direction of the magnetic field developed by the solenoid unit 20 is reversed with reversal of the direction of flow of the electric current through the solenoid unit 20. In correspondence with the repeated reversal of the direction of the magnetic field developed by the solenoid unti 20, the operating member 14 can be axially reciprocated between the first and second positions P1 and P2 together with the rod magnet 16.

Thus, it will be understood that the third preferred embodiment of the present invention shown in and described with reference to FIGS. 6 and 7 differs from the first preferred embodiment of the present invention shown in and described with reference to FIGS. 1 to 3 in that, in the third preferred embodiment, (a) the rod magnet 16 is integrated with the operating member 14 while the permanent magnet pieces are fast with the support structure 10, (b) the operating member 14 is driven in the direction axially of the rod magnet 16, and (c) both of the opposite poles produced in the rod magnet 16 are utilized to establish a magnetic field between one of the permanent magnet rings 33*a* and 34*a* and the adjacent one of the opposite poles of the rod magnet 16 and also between the other of the permanent magnet rings 33*a* and 34*a* and the other of the opposite poles of the rod magnet 16. In particular, the difference (c) brings about an additional advantage in that a relatively great driving force can be obtained for driving the operating member 14 between the first and second positions P1 and P2.

In any event, the magnetically operated actuator according to the third preferred embodiment of the present invention can bring about effects similar to those afforded by the magnetically operated actuator according to any one of the first and second preferred embodiments of the present invention, except that the resistance to the axial movement of the operating member 14 is relatively large and also except for the effect brought about by the utilization of the single pole of the rod magnet 16.

Figure 8:
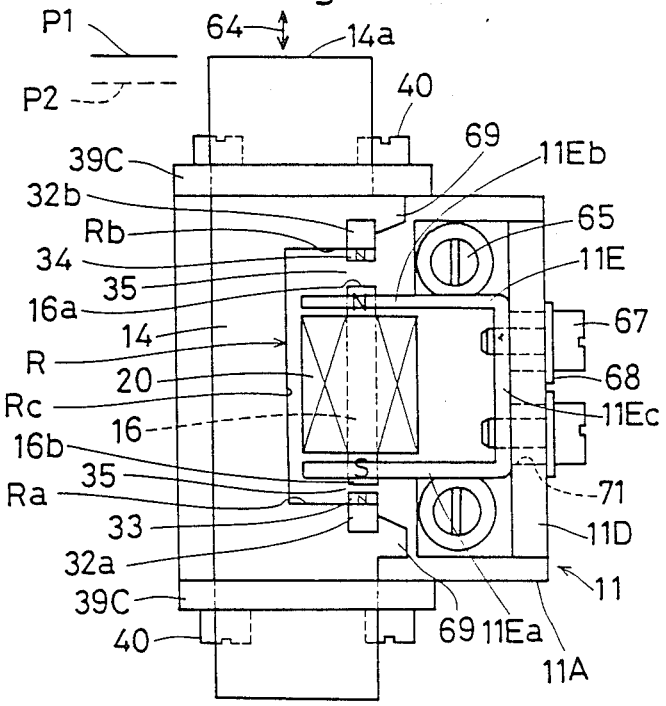
FIG. 8 is a schematic top plan view of the magnetically operated actuator according to a fourth preferred embodiment of the present invention.
Figure 9:
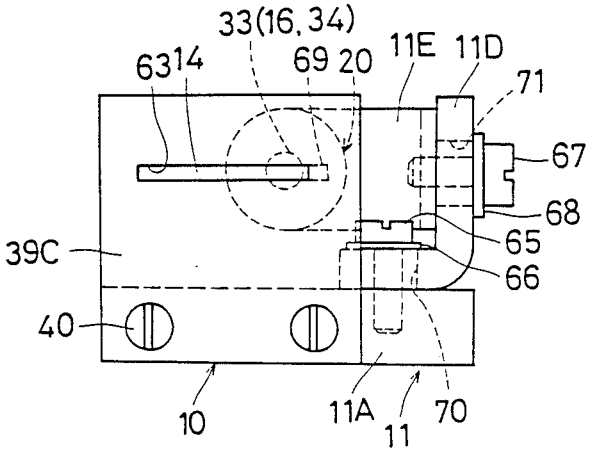
FIG. 9 is a schematic side view of the magnetically operated actuator shown in FIG. 8.

The other example in which the operating member 14 moves between the first and second positions P1 and P2 in a direction longitudinally thereof and parallel to the longitudinal axis of the rod magnet 16 is illustrated in FIGS. 8 and 9.

According to a fourth preferred embodiment of the present invention shown in FIGS. 8 and 9, the support structure 10 comprises the base 11A, a pair of side plates 39C secured to the opposite sides of the base 11A by means of respective sets of set screws or bolts generally identified by 40 so as to extend perpendicular to the base 11A in parallel relationship with each other, and a generally L-sectioned frame member 11D rigidly mounted on the base 11A by means of a plurality of bolts 65, extending through associated washers 66 and firmly threaded into the base 11A, so as to extend in a direction perpendicular to any one of the side plates 39C.

Each of the side plates 39C has a slot 63 defined therein with its longitudinal axis lying parallel to the base 11A. The operating member 14 which in the embodiment shown in FIGS. 8 and 9 is of a generally rectangular configuration is axially slidably accommodated in the slots 63 in the respective side plates 39C for movement between the first and second positions P1 and P2 in a direction longitudinally thereof as shown by the arrow 64 in FIG. 8.

On one side of the operating member 14 facing the L-sectioned frame member 11D, the operating member 14 is formed with a generally U-shaped recess R cut inwardly of the operating member 14 and delimited by a pair of opposite end edges Ra and Rb and a longitudinal edge Rc, the length of each of said end edges Ra and Rb being smaller than that of the longitudinal edge Rc. The permanent magnet pieces 33 and 34 are rigidly mounted through respective mounts 32*a* and 32*b* on the associated end edges Ra and Rb of the operating member 14 so as to confront with each other in a direction parallel to the longitudinal sense of the operating member 14 with the recess R positioned therebetween.

The solenoid unit 20 including the rod magnet 16 and the winding formed around the rod magnet 16 is supported by the L-shaped frame member 11D by means of a generally U-shaped bracket 11E made of a non-magnetizable material in a manner which will now be described.

The U-shaped bracket 11E has a pair of opposite arms 11Ea and 11Eb and a connecting base 11Ec connecting the arms 11Ea and 11Eb together so as to render the bracket 11E as a whole to represent a generally U-shaped configuration. This U-shaped bracket 11E is secured, preferably adjustably, to the L-shaped frame member 11D by means of a plurality of, for example, two screw members 67 extending through respective washers 68 and then through respective holes 71 in the L-shaped frame member 11D and threaded to the connecting base 11Ec of the U-shaped bracket 11E. With the bracket 11E so secured to the frame member 11D in the manner described above, the opposite arms 11Ea and 11Eb of the bracket 11E extend perpendicular to the frame member 11D and towards the operating member 14 and terminating within the recess R defined in the operating member 14. The span between the opposite arms 11Ea and 11Eb of the bracket 11E is so selected as to be smaller than the axial span between the opposite end edges Ra and Rb of the operating member 14 by an amount generally determined in consideration of the stroke between the first and second positions P1 and P2 for the movement of the operating member 14.

The solenoid unit 20 is mounted on the U-shaped bracket 11E with the opposite ends 16*a* and 16*b* of the rod magnet 16 fixedly extending through the respective arms 11Eb and 11Ea and terminating on one side opposite to the associated arms 11Eb and 11Ea, said rod magnet 16 being held in alignment with any one of the permanent magnet pieces 33 and 34.

Preferably, each of the holes 71 through which a threaded shank of the associated screw member 67 is so selected to be greater than the outer diameter of such threaded shank of the associated screw member 67 that the position of the solenoid unit 20, including the rod magnet 16, relative to the permanent magnet pieces 33 and 34 can be adjusted to accomplish an exact axial alignment between the rod magnet 16 and the permanent magnet pieces 33 and 34 and also to adjust the size of each of the clearance between the end 16*a* of the rod magnet 16 and the associated permanent magnet piece 34 and the clearance between the end 16*b* of the rod magnet 16 and the associated permanent magnet piece 33, both of said clearances being generally identified by 35. In combination therewith or independently thereof, each of the holes 70 defined in the frame member 11D for the passage of the respective bolt 65 therethrough may have a diameter greater than the outer diameter of the threaded shank of such bolt 65 so that the position of the solenoid unit 20 in a plane parallel to the base 11A can be accurately adjusted relative to the operating member 14.

It is to be noted that, in mounting each of the permanent magnet pieces 33 and 34 on the operating member 14 through the respective mounts **32*a* and 32*b*, only one of the opposite poles thereof, for example, the north pole so far shown, is utilized and, therefore, the respective permanent magnet piece is mounted through the associated mount 32 on the operating member 14 with the north pole thereof oriented towards the associated end 16*b* or 16*a* of the rod magnet 16. In this condition, the rod magnet 16 has its south and north poles confronting the permanent magnet pieces 33 and 324, respectively, as best shown in FIG. 8**.

For restricting the stroke of axial movement of the operating member 14 between the first and second positions P1 and P2, the operating member 14 in this emboidment of FIGS. 8 and 9 is formed with a pair of spaced projections 69 at respective locations adjacent the permanent magnet pieces 33 and 34 and protruding outwardly from the side edge of the operating member 14 in a direction towards the frame member 11D. These projections 69 are adapted to be brought into engagement with the adjacent side plates 39C when the operating member 14 is moved from the first position P1 to the second position P2 and from the second position P2 to the first position P1, respectively. Accordingly, it will readily be seen that portions of the side plates 39C adjacent the respective slots 63 through which the operating member 14 movably extends, together with the associated projections 69, constitute the stopper means for restricting the stroke of movement of the operating member 14 between the first and second positions P1 and P2.

While the magnetically operated actuator according to the fourth preferred embodiment shown in and described with reference to FIGS. 8 and 9 are so constructed as hereinbefore described, it makes use of the opposite poles of the rod magnet 16 as is the case with the magnetically operated actuator according to the third preferred embodiment shown in and described with reference to FIGS. 6 and 7. However, the fourth embodiment differs from the third embodiment in that the rod magnet 16 is held immovable and rigid with the support structure 10 while the permanent magnet pieces 33 and 34 are mounted on the operating member 14 for movement together therewith. Except for these differences, however, the magnetically operated actuator shown in and described with reference to FIGS. 8 and 9 functions in a substantially similar manner to, and can bring about similar effects as brought about by, the magnetically operated actuator according to the embodiment shown in and described with reference to FIGS. 6 and 7.

Although the present invention has been fully described in connection with the preferred embodiments thereof with reference to the accompanying drawings, it is to be noted that numerous changes and modifications can readily be conceived by those skilled in the art within the framework of obviousness. By way of example, where any movable element to be driven by the magnetically operated actuator according to the present invention has a similar stopper means for restricting the stroke of movement of such movable element, the use of the stopper means in the magnetically operated actuator according to the present invention may be dispensed with.

Accordingly, such changes and modifications are, unless they depart from the scope of the present invention as defined by the appended claims, to be construed as included therein.

What is claimed is:

1. A magnetically operated actuator which comprises:

a support structure;

a generally elongated operating element mounted on the support structure for selective displacement between first and second positions;

at least one electromagnet assembly for driving the operating element to displace the latter between the first and second positions under the influence of magnetism emanating therefrom, said electromagnet assembly comprising a first magnetic member and a solenoid unit disposed around the first magnetic member and adapted to develop a magnetic field when electrically energized, said first magnetic member being exposed in the magnetic field developed by the solenoid unit when said solenoid unit is electrically energized;

at least two second magnetic members cooperable with the first magnetic member, wherein each of the second magnetic members has a pole facing to the first magnetic member and the poles of two magnetic members have polarities opposite to each other, thereby developing magnetic force of attraction between one of the second magnetic members and the first magnetic member and at the same time magnetic force of repulsion between the other of the second magnetic members and the first magnetic member;

one of said first and second magnetic members being fixed to the support structure and the other of the first and second magnetic members being fixed to the operating member, said solenoid unit being fixed to the support structure;

said first magnetic member being made of a permanent magnet having a relatively small coercive force enough to permit the opposite poles of the first magnetic member to be reversed in position with reversal of the direction of the magnetic field developed by the solenoid unit; and each of said second magnetic members being made of a permanent magnet having a relatively great coercive force enough to permit the opposite poles of the respective second magnetic member not to be affected by reversal of the direction of the magnetic field developed by the solenoid unit.

2. The magnetically operated actuator as claimed in claim 1, further comprising means mounted on the support structure for restricting the stroke of movement of the operating element between the first and second positions.

3. The magnetically operated actuator as claimed in claim 1, wherein said second magnetic members are fixedly mounted on the operating element and spaced a predetermined distance from each other and wherein said first magnetic member is of a generally rod-like configuration and is coaxialy fixed to the solenoid unit, said first magnetic member being fixedly supported with one of its opposite ends confronting any one of the second magnetic members.

4. The magnetically operated actuator as claimed in claim 3, wherein said operating element is in the form of a generally elongated plate and is pivotally supported at a generally intermediate portion thereof by the support structure for pivotal movement in a plane perpendicular to any one of the opposite surfaces of the operating element, and wherein said second magnetic members are mounted on one of the opposite ends of the operating element and positioned one above the other in a plane in which the operating element pivots, one of said second magnetic members having one magnetic pole confronting the first magnetic member while the other of said second magnetic members has a magnetic pole, opposite in polarity to that of said one pole, confronting the first magnetic member, the opposite end of the operating element being movable between the first and second positions during the angular displacement of the operating member about the pivot shaft.

5. The magnetically operated actuator as claimed in claim 4, further comprising means mounted on the support structure for restricting the stroke of movement of the operating element between the first and second positions, said restricting means being engageable with any one of the opposite surfaces of the operating element adjacent said opposite end of the operating element.

6. The magnetically operated actuator as claimed in claim 3, wherein said operating element is in the form of a generally elongated plate and is pivotally supported at a generally intermediate portion thereof by the support structure for pivotal movement in a plane parallel to any one of the opposite surfaces of the operating element, and wherein said second magnetic members are mounted on one of the opposite ends of the operating element and positioned in side-by-side relationship in a plane in which the operating element pivots, one of said second magnetic members having one magnetic pole confronting the first magnetic member while the other of said second magnetic members has a magnetic pole, opposite in polarity to that of said one pole, confronting the first magnetic member, the opposite end of the operating element being movable between the first and second positions during the angular displacement of the operating member about the pivot shaft.

7. The magnetically operated actuator as claimed in claim 6, further comprising means mounted on the support structure for restricting the stroke of movement of the operating element between the first and second positions, said restricting means being engageable with any one of opposite side faces of the operating element adjacent said opposite end of the operating element.

8. The magnetically operated actuator as claimed in claim 1, wherein the first magnetic member is of a generally rod-like configuration and is axially movably supported inside the solenoid unit in coaxial relationship with the solenoid unit and said operating element is connected with the first magnetic member for movement together therewith in a direction axially thereof, and wherein each of the second magnetic members is in the form of a ring and is fixed to a respective end of the solenoid unit in coaxial relationship therewith, a portion of the operating element opposite to the connection between the operating element and the first magnetic member being movable between the first and second positions during the axial displacement of the operating element.

9. The magnetically operated actuator as claimed in claim 1, wherein the support structure includes a pair of support plate members spaced apart from each other and having respective support slots defined therein in alignment with each other, said operating element being in the form of a generally elongated plate and axially movably supported by the support structure while movably extending through the support slots, and wherein said first magnetic member is of a generally rod-like configuration and said electromagnet assembly is fixedly supported by the support structure with the first magnetic member lying parallel to the longitudinal sense of the operating element, the second magnetic members being fixedly mounted on the operating element so as to confront the opposite ends of the first magnetic member, one of said second magnetic members having one magnetic pole confronting one of the opposite ends of the first magnetic member while the other of said second magnetic members has a magnetic pole, the same in polarity as that of said one pole, confronting the other of the opposite ends of the first magnetic member, said operating element being displaceable between the first and second positions in a direction axially thereof.

10. The magnetically operated actuator as claimed in claim 1, wherein the coercive force of the first magnetic member is within the range of 150 to 1,500 oersteds.

11. The magnetically operated actuator as claimed in claim 1, wherein the coercive force of the first magnetic member is within the range of 200 to 500 oersteds.

12. The magnetically operated actuator as claimed in claim 1, wherein the coercive force of each of the second magnetic members is 2,000 oersted or higher.

13. The magnetically operated actuator as claimed in claim 10, wherein the coercive force of each of the second magnetic members is 2,000 oersted or higher.

* * * * *